United States Patent [19]

Steel et al.

[11] Patent Number: 4,603,070

[45] Date of Patent: Jul. 29, 1986

[54] NON-WOVEN FIBROUS MATERIALS

[75] Inventors: Margaret L. Steel, Runcorn, England; Philip Norton-Berry, Llandegla, Wales

[73] Assignee: Imperial Chemical Industries PLC, London, England

[21] Appl. No.: 777,739

[22] Filed: Sep. 19, 1985

[30] Foreign Application Priority Data

Oct. 3, 1984 [GB] United Kingdom ..... 8424950

[51] Int. Cl.[4] ..... A61L 15/00; A61L 15/04; B29B 9/02

[52] U.S. Cl. ..... 428/88; 156/62.4; 264/8; 428/95; 428/194; 428/198; 428/288; 428/296; 428/395; 523/105; 604/370; 604/372; 604/378

[58] Field of Search ..... 428/288, 296, 88, 95, 428/194, 198, 395; 264/115, 8; 156/62.4; 604/370, 372, 378

[56] References Cited

U.S. PATENT DOCUMENTS

| | | | |
|---|---|---|---|
| 3,225,766 | 12/1965 | Baptist et al. | 528/361 |
| 4,360,488 | 11/1982 | Barham et al. | 264/210.1 |
| 4,385,026 | 5/1983 | Barham | 264/290.2 |
| 4,534,349 | 8/1985 | Barrows | 128/334 R |

FOREIGN PATENT DOCUMENTS

| | | |
|---|---|---|
| 52459 | 5/1982 | European Pat. Off. . |
| 69497 | 1/1983 | European Pat. Off. . |

OTHER PUBLICATIONS

Wallen et al. *Environmental Science and Technology*, vol. 8 (6), Jun., 1974, pp. 576–579.

*Primary Examiner*—James C. Cannon
*Attorney, Agent, or Firm*—Cushman, Darby & Cushman

[57] ABSTRACT

A fibrous non-woven material, comprising a coherent mass of hydrophilic fibres spun from a polymer comprising at least 40 mol % 3-hydroxybutyrate residues, a process therefor, and an article comprising the material with a water-impervious backing e.g. a wound dressing.

12 Claims, 1 Drawing Figure

NON-WOVEN FIBROUS MATERIALS

Figure 1:
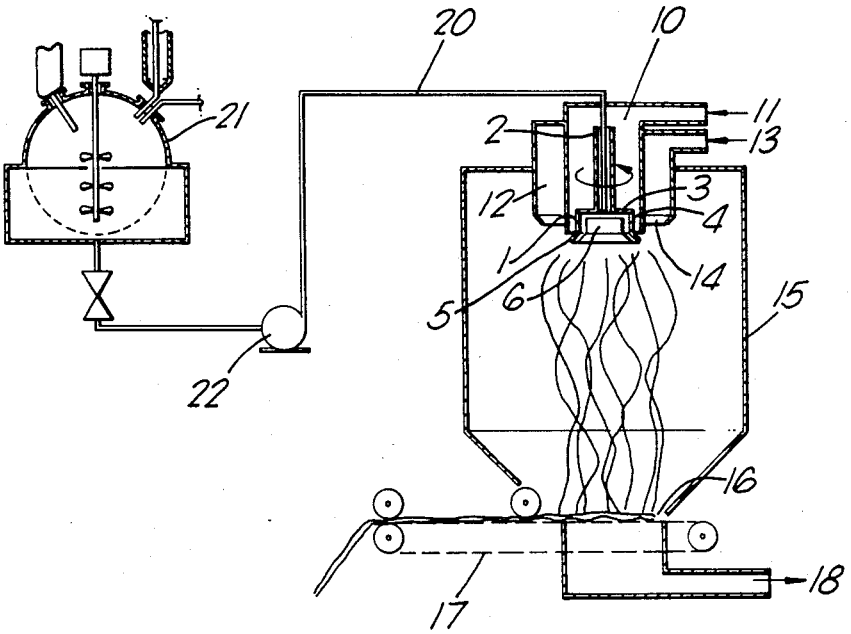

The invention relates to non-woven materials which are suitable for a variety of medical applications, including surgical, veterinary and dental applications.

According to the present invention we provide a fibrous non-woven material for medical applications, comprising a coherent mass of hydrophilic fibres spun from a hydroxybutyrate (HB) polymer.

Poly(3-hydroxybutyrate) (PHB) is a known thermoplastic polymer, which is generally manufactured biochemically. It is extracted from the biochemical soup using solvents, and after removal of proteins, cell debris etc, can conveniently be dry spun from the purified extraction solution modified as described hereinafter. Suitable solvents include chloroform and methylene chloride. Being a thermoplastic polymer, PHB can also be melt spun.

Polymers containing both 3-hydroxybutyrate units and other hydroxycarboxylic acid units, such as 3-hydroxyvalerate units, can also be produced microbiologically. Thus a microbiologically produced heteropolymer containing 3-hydroxybutyrate and 3-hydroxyvalerate residues is described by Wallen et al in "Environmental Science and Technology" 8 (1974) 576-9. Also, as described in EP-A-52459 and 69497 various copolymers can be produced by cultivating the micro-organism on certain substrates, such as propionic acid which gives rise to 3-hydroxyvalerate units in the copolymer.

Accordingly, in the present specification, by the term HB polymer we mean not only the homopolymer, but also copolymers as described above, provided that the 3-hydroxybutyrate residues form at least 40 mol %, and preferably at least 50, mol % of the polymer chain.

HB polymers may be processed similarly to PHB. One particular HB polymer is PHB.

HB polymers are hydrophobic materials, and so for the present invention the HB polymer requires steps to be taken to render it hydrophilic. When dry spinning, we prefer to dissolve a surfactant in the solution before spinning. An example of a surfactant which may be added in this manner is Empilan CDE, a surfactant coconut oil derivative. A surfactant which is soluble in the solvent system but incompatible with the HB polymer may migrate to the surface as the solvent evaporates, but if this is too severe it can be lost on washing. Surfactants can be added to the melt for melt spinning. Post-spinning treatment can be used as an alternative, but this appears to be generally less effective.

The non-woven material can be made in a variety of forms, such as for example a bulky padding with high take up of aqueous liquids, e.g. for use as swabs, or as a fine gossamer-like gauze, as a lint or fleece, or as an elongated sausage which can be cut to a length as required. These differences can be achieved during spinning by varying the conditions of collection and by varying the degree of coherence. By referring to the material as a coherent mass of fibres we mean that when the materials are disturbed, they tend to retain their identity, according to the degree of coherence achieved. This can vary from a fleece of entangled long fibres, where the entanglement of the long fibres gives a low degree of coherence, to, at the other end of the scale, a highly melded gauze having a dimensional stability determined by the strength of the fibres themselves.

Coherence can also be increased by compressing the material over all or a part of its surface area. For example a sheet of bouncey fleece may be compressed at a plurality of points over the surface area, to give an embossed pattern, or a peripheral zone may be heated and/or compressed to seal the edges. Even when cutting portions from a bulk supply such as a sausage, using scissors, the pressure along the shear line can be sufficient to seal the edges. Such compressed areas can generally be pulled apart again, although they can be made so as to stand up to quite rough handling, by applying sufficient pressure.

The present materials are particularly suited to medical applications as they are safe in vivo. They may be left in place to aid clotting without the rejection problems associated with cotton materials, and swabs, pads or the like left in the body by design or by accident will not of themselves (i.e. if sterilised) cause toxemia. They are slowly absorbed by the body or are otherwise biodegradable. Being hydrophilic they will take up aqueous liquids. They differ from cotton wool in having little or no tendency to break off small fibres, but even if small pieces were to enter a wound, they would be safe, as described above.

There is accordingly no need to enclose them in a retaining gauze, and hence they can be readily tailored to size at the point of use. They can also be made relatively cheaply.

Desirably such materials should be sterilised prior to use. Sterilisation may be affected by heating at temperatures in the range 100° to 150° C. or by $\gamma$-irradiation.

Desirably such materials should be sterilised prior to use. Sterilisation may be affected by heating at temperatures in the range 100° to 150° C. or by -irradiation.

In accordance with a further aspect of the invention we therefore provide a sterilised fibrous non-woven material of the invention.

The invention is illustrated by reference to a specific form of apparatus we have found to be particularly suitable for producing the present materials, and to particular materials we have produced on such apparatus, reference being made to the accompanying drawing in which The FIGURE shows an apparatus for making a random fleece of the material of the present invention.

The apparatus shown in the FIGURE has an inverted spinning bowl mounted for rotation on a hollow shaft 2, opening into the base 3 of the bowl. The sides 4 of the bowl are cylindrical as they extend from the base, flaring outwards towards the rim 5, and the inner surface of the bowl may be fluted to assist fibre formation. The space inside the bowl is almost filled with a core 6, which is supported by the bowl so as to be rotatable with it and so as to leave a gap between it and the bowl's sides and base.

Immediately around the bowl is a cold air chamber 10 to control the temperature of the bowl, with a cold air inlet 11 at the top and a gap for the air to escape near the rim of the bowl. Around this is a hot air chamber 12 with a supply 13 at its upper end and a vent 14 for directing a rapid annular stream of hot gas, downwards just outside the rim of the bowl, which is insulated from the hot gas by the cold chamber 10. Around the bowl and its surrounding chambers, and extending downwards below them, is a container 15 with an open mouth 16 at its lower end. Below the open mouth is a porous conveyer 17, overlying a vent 18 through which suction may be applied.

Down the centre of the hollow shaft 2, is a supply pipe 20, leading from a supply flask 21 in which a spinning solution can optionally be prepared or simply stored after separate preparation and filtration as necessary, and delivered by a pump 22 to the spinning rig.

In use the bowl is spun at high speed, typically 4000–8000 rpm for a bowl having a 4 inch diameter rim. We prefer to use a solution of HB polymer having the highest concentration which does not gel out at the process temperature, and this can be aided by spinning hot solutions. For PHB having a molecular weight of about 1,000,000, spinning solutions of 10–20% w/v PHB and 1–2% w/v of surfactant in chloroform or methylene chloride at 60° C., are generally suitable. The hot solution is pumped under pressure onto the top of the core 6, where it is flung out onto the sides of the bowl by centrifugal forces. These forces spread out the solution, until it reaches the rim and becomes discharged as continuous filaments. These meet the downward blast of hot air, and are thus carried downwards while the solvent evaporates, to fall through the mouth of the container and onto the conveyor.

By drying the fibres fully as they fall, and by applying suction to the vent while moving the conveyor slowly forwards, the filaments falling onto the conveyor become entangled to form a pad of fleece-like material, held together by the entanglement of the filaments and their inherent slight tackness brought into effect by the suction drawing them down together.

Greater coherence can be obtained by melding the fibres as they are produced. This can be achieved when dry spinning by arranging the conditions such that the filaments are not entirely free from solvent so that they are tacky when they are brought together. Where they contact one another under the various degrees of compaction, they become fused together ('moulded'). The degree of melding and hence of coherence in the final material, can be varied by varying the amount of solvent retained by the fibres when they contact, and further coherence can be obtained by pressing the fibres in the presence of solvent. However, for most HB polymers, substantial pressures are not required fo the initial melding of the fibres. Melt spun fibres can be melded by bringing them together before they have cooled sufficiently to prevent fusion.

The filaments may be collected conventionally. For example the sausage form can be made by winding the filaments on a support as they are produced, to build up a sausage shape. The degree of melding can be controlled by varying the position of te support with respect to the bowl as spinning occurs. By starting the winding remote from the bowl and then moving the partly-formed sausage towards the bowl, a porous skin of more melded material can be formed around a looser core.

A spinning apparatus essentially similar to those shown in the drawings can be used for melt spinning, either by feeding the polymer from an extruder or a pressurised melting pot, or, by using a stationary wider feed pipe, powder from a powder feeder can be fed onto a heated bowl, where it melts before being discharged from the rim as molten filaments.

We claim:

1. A fibrous non-woven material for medical applications comprising a coherent mass of hydrophilic fibres spun from a hydroxybutyrate polymer.

2. A material according to claim 1 wherein the polymer is poly(3-hydroxybutyrate).

3. A material according to claim 1 or 2 wherein the hydrophilicity is conferred by a surfactant.

4. A material according to any one of claims 1 to 3 which is a gauze or lint.

5. A material according to any one of claims 1 to 4 which is highly melded.

6. A material according to any one of claims 1 to 5 which has been compressed over all or part of its surface including the edges thereof.

7. A material according to any one of claims 1 to 6 which is sterile.

8. A process for producing a material according to any one of claims 1 to 7 which comprises centrifugally spinning a hydroxybutyrate polymer.

9. A process according to claim 8 wherein the spinning is solution spinning.

10. A process according to claim 9 wherein the solution has the highest possible non-gelling concentration of hydroxybutyrate polymer at the process temperature.

11. A process according to claim 8 wherein the spinning is melt spinning.

12. An article comprising a material according to any one of claims 1 to 7 and a water-impermeable backing.

* * * * *